US008699304B2

(12) United States Patent
Sakumoto et al.

(10) Patent No.: US 8,699,304 B2
(45) Date of Patent: Apr. 15, 2014

(54) ELECTRONIC DEVICE, ELECTRONIC DEVICE CONTROL METHOD, AND ELECTRONIC DEVICE CONTROL PROGRAM

(75) Inventors: Kazumi Sakumoto, Chiba (JP); Keishi Honmura, Chiba (JP); Saburo Manaka, Chiba (JP); Kosuke Yamamoto, Chiba (JP); Kenji Ogasawara, Chiba (JP); Hiroshi Shimizu, Chiba (JP)

(73) Assignee: Seiko Instruments Inc. (JP)

( * ) Notice: Subject to any disclaimer, the term of this patent is extended or adjusted under 35 U.S.C. 154(b) by 387 days.

(21) Appl. No.: 13/199,492

(22) Filed: Aug. 31, 2011

(65) Prior Publication Data

US 2012/0057436 A1 Mar. 8, 2012

(30) Foreign Application Priority Data

Sep. 3, 2010 (JP) ..... 2010-198083
Jun. 21, 2011 (JP) ..... 2011-137042

(51) Int. Cl.

| | |
|---|---|
| ***G04C 3/00*** | (2006.01) |
| ***G04G 19/00*** | (2006.01) |
| ***G04C 10/02*** | (2006.01) |
| ***G04G 19/10*** | (2006.01) |

(52) U.S. Cl.

CPC ..... *G04C 10/02* (2013.01); *G04G 19/00* (2013.01); *G04G 19/10* (2013.01)
USPC ..... 368/64; 368/66; 368/204; 368/205; 320/101; 320/166

(58) Field of Classification Search

USPC ..... 368/64, 66, 203–204; 320/101, 137, 320/162, 166; 323/906
See application file for complete search history.

(56) References Cited

U.S. PATENT DOCUMENTS

| | | | | |
|---|---|---|---|---|
| 4,240,021 | A * | 12/1980 | Kashima et al. | 320/101 |
| 4,759,003 | A * | 7/1988 | Kiyono et al. | 368/66 |
| 5,798,985 | A * | 8/1998 | Nakajima | 368/64 |
| 6,144,621 | A * | 11/2000 | Sase | 368/204 |
| 6,320,822 | B1 * | 11/2001 | Okeya et al. | 368/66 |
| 6,424,600 | B1 * | 7/2002 | Okeya et al. | 368/204 |
| 6,463,010 | B1 * | 10/2002 | Nakamiya et al. | 368/64 |

FOREIGN PATENT DOCUMENTS

| | | |
|---|---|---|
| JP | 2000 230988 | 8/2000 |

* cited by examiner

*Primary Examiner* — Vit W Miska
(74) *Attorney, Agent, or Firm* — Adams & Wilks

(57) ABSTRACT

An electronic device includes a primary power supply portion generating power by converting a first energy into electric energy as a second energy; a secondary power supply portion storing the electric energy obtained by the power generation; a charge detection portion detecting a state where the secondary power supply portion is not charged with the electric energy; a clocking portion clocking time and stopping display of clocked time when an operation input is detected; and a low power consumption state control portion which measures a time of a state where the operation input is detected and the charging is not performed, and stops the operation of the clocking portion when the measured time exceeds a preset time.

10 Claims, 8 Drawing Sheets

ELECTRONIC DEVICE, ELECTRONIC DEVICE CONTROL METHOD, AND ELECTRONIC DEVICE CONTROL PROGRAM

BACKGROUND OF THE INVENTION

1. Field of the Invention

The present invention relates to an electronic device, an electronic device control method, and an electronic device control program.

2. Background Art

Small electronic devices such as a timepiece device including a wristwatch which is equipped with a power generating unit such as a solar cell and a secondary power supply have been put to practical use. In the electronic devices, power generated by the power-generating unit is charged to the secondary power supply, and time is displayed by the power supplied from the secondary power supply. As a result, power supply with stabilized output has been realized without replacing the power source.

In the electronic device, if power is kept supplied for a long time from the secondary power supply while the power-generating unit does not generate power, the secondary power supply gets into an overdischarged state in which the charge stored in the secondary power supply becomes zero. In the overdischarged state, even if power starts to be supplied from the power-generating unit, the electronic device cannot be operated until sufficient charge is stored in the secondary power supply.

JP-A-2000-230988 discloses an electronic device in which when a normal operation state is continued for a certain period of time while power is not supplied, the operation state transits to a low power consumption state in which time is not displayed, whereby the power consumption is suppressed.

However, in the invention disclosed in JP-A-2000-230988, there is a case that it is difficult for the power-generating unit to generate power depending on the usage environment, and the operation state transits to the low power consumption state. For example, in a wristwatch to which the invention of JP-A-2000-230988 is applied, when light is blocked since the wristwatch is covered by cuffs, or when the wristwatch is not irradiated with light in the night, power generation is not performed. If the power generation is not performed for a certain period of time, time display is stopped.

Furthermore, the invention disclosed in JP-A-2000-230988 has a drawback that the electronic device is overdischarged depending on the length of time for which the power generation is not performed, and it takes time to resume the operation of the electronic device. For example, after the device is shipped from a factory, if the device is overdischarged since the device has not been irradiated with light for a long time, the time display is not performed until the operation of the device is resumed. This state leads to a concern that a user might misunderstand the device is out of order.

As described above, the invention disclosed in JP-A-2000-230988 has a drawback that there is a case that the user cannot check the time display when he or she wants to check time.

SUMMARY OF THE INVENTION

It is an aspect of the present application to provide an electronic device, a control method of the electronic device, and a control program of the electronic device, which make it possible to sufficiently secure time for which the user can check the time display.

(1) Another aspect of the present application is an electronic device including: a primary power supply portion generating power by converting a first energy into electric energy as a second energy; a secondary power supply portion storing the electric energy obtained by the power generation; a charge detection portion detecting a state where the secondary power supply portion is not charged with the electric energy; a clocking portion clocking time and stopping display of clocked time when an operation input is detected; and a low power consumption state control portion which measures a time of a state where the operation input is detected and the charging is not performed, and stops the operation of the clocking portion when the measured time exceeds a preset time.

(2) Another aspect of the present application is the electronic device further including a voltage detection portion detecting supply voltage of the secondary power supply portion, wherein the charge detection portion detects a state where the secondary power supply portion is charged with the electric energy, and the low power consumption state control portion stops the operation of the clocking portion when the supply voltage of the secondary power supply portion is higher than the voltage required for the operation of the device, and starts the operation of the clocking portion when the charged state is detected.

(3) Another aspect of the present application is the electronic device wherein the low power consumption state control portion selects an operation state of the clocking portion when the clocking portion starts its operation, according to the operation state of the clocking portion before the clocking portion stopped its operation.

(4) Another aspect of the present application is the electronic device wherein the clocking portion is configured with a clocking control portion and an oscillation circuit control portion for generating clock signals to drive the clocking control portion, and the operation of the clocking portion is stopped when the oscillation circuit control portion stops generating the clock signals.

(5) Another aspect of the present application is the electronic device wherein the clocking control portion includes a pulse down counter portion which measures a time until the amount of energy of driving signals generated based on the clock signals is reduced, and the pulse down counter portion measures a time of a state where the charging is not performed.

(6) Another aspect of the present application is the electronic device wherein the clocking control portion includes a chronograph counter portion which measures a time elapsing from a point of time when the operation input is detected, and the chronograph counter portion measures a time of a state where the charging is not performed.

(7) Another aspect of the present application is the electronic device wherein the first energy is light energy.

(8) Another aspect of the present application is the electronic device wherein the operation input is voltage according to the position of a winder.

According to the application, the operation input for stopping the time display is detected, and then the operation of the clocking portion is stopped after the time for which the device is not charged with the electric energy generated by the primary power supply portion exceeds a preset time. As a result, the application can solve a problem that the user cannot check time due to the operation stop of the clocking portion against the user's will. That is, it is possible to make sufficient time for the user to check the time display.

DETAILED DESCRIPTION OF THE INVENTION

First Embodiment

Hereinafter, the first embodiment of the invention will be described in detail with reference to drawings.

Figure 1:
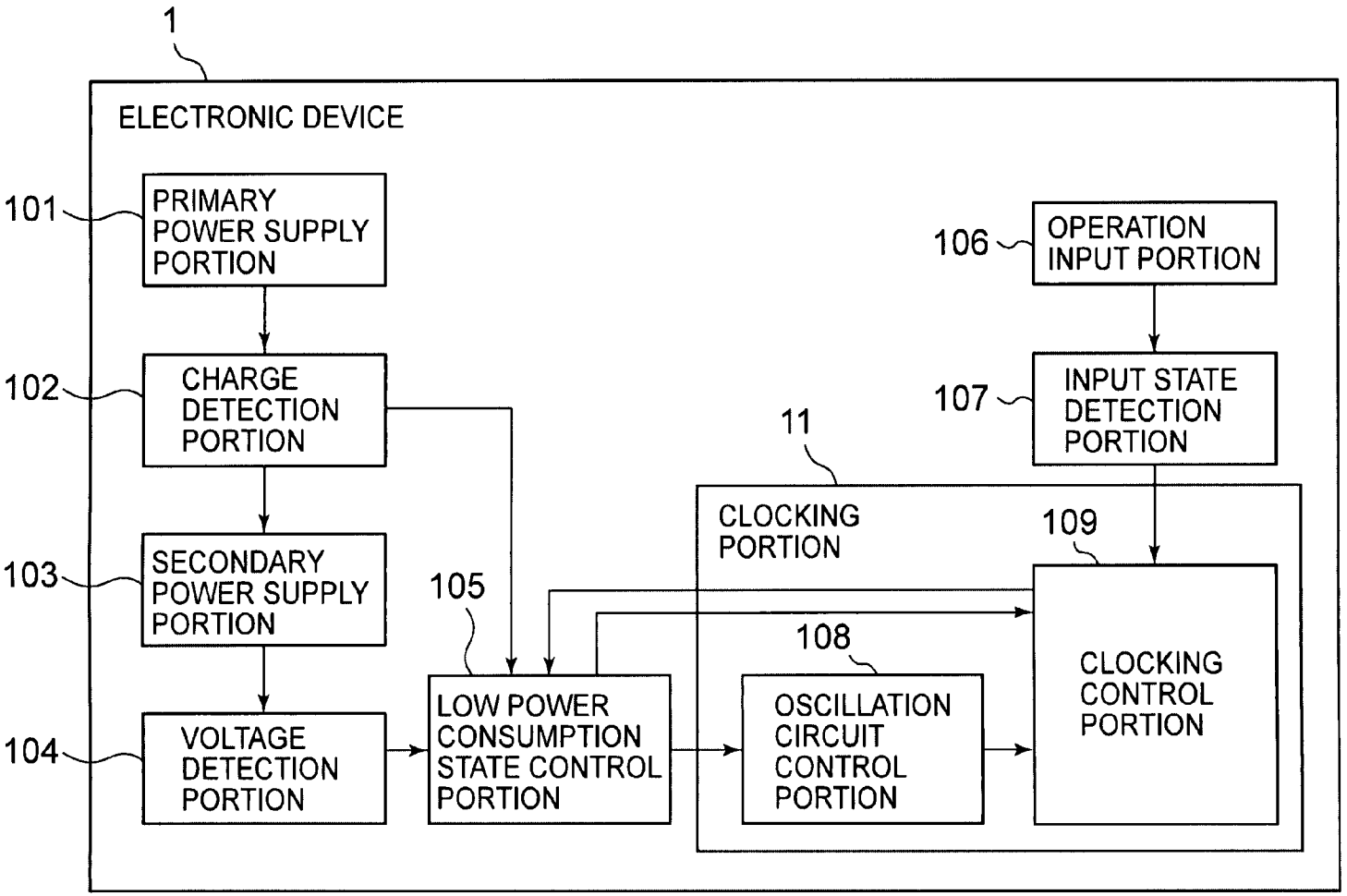
FIG. 1 is a schematic block diagram of an electronic device according to a first embodiment of the invention.

FIG. 1 illustrates an electronic device 1 according to the embodiment. The electronic device 1 is configured with a primary power supply portion 101, a charge detection portion 102, a secondary power supply portion 103, a voltage detection portion 104, a low power consumption state control portion 105, an operation input portion 106, an input state detection portion 107, and a clocking portion 11. The clocking portion 11 is configured with an oscillation circuit control portion 108 and a clocking control portion 109. The electronic device 1 is a clocking device such as a wristwatch. However, the invention is not limited thereto, and the device may be an electronic device which includes a function of consecutively displaying time and is driven by means of control signals from an oscillation circuit. The electronic device 1 also includes an analogue watch having a mechanism of moving watch hands and displaying time by the position of the hands, in addition to a digital watch displaying time by numerical values.

The primary power supply portion 101 converts a first energy into electric energy, thereby generating power. The primary power supply portion 101 outputs the generated power to the secondary power supply portion 103 through the charge detection portion 102. The primary power supply portion 101 is a solar cell using light energy as the first energy. Since the solar cell converts light emitted to its own solar panel into electric energy, the power to be generated depends on the amount of the light emitted, and the output power is unstable in general.

The charge detection portion 102 detects a state where the power generated by the primary power supply portion 101 is accumulated in the secondary power supply portion 103, that is, whether or not the device is in a charged state. Specifically, when the voltage of the power generated by the primary power supply portion 101 is higher than the voltage of the power accumulated in the secondary power supply portion 103, the charge detection portion 102 determines that the device is in the charged state. On the other hand, when the voltage of the power generated by the primary power supply portion 101 is lower than the voltage of the power accumulated in the secondary power supply portion 103, the charge detection portion 102 determines that the device is a non-charged state.

In the charged state, current flows from the primary power supply portion 101 to the secondary power supply portion 103. The charge detection portion 102 includes a back-flow prevention element between the primary power supply portion 101 and the secondary power supply portion 103. By using the element, the charge detection portion 102 prevents the loss of power accumulated in the secondary power supply portion 103, which is caused by the reversal of current from the secondary power supply portion 103 to the primary power supply portion 101. As the back-flow prevention element, for example, a diode which allows power to pass only one-way (from the primary power supply portion 101 to the secondary power supply portion 103) is used. The charge detection portion 102 outputs charge state information showing whether the secondary power supply portion 103 is in the charged state or the non-charged state to the low power consumption state control portion 105.

In the secondary power supply portion 103, the power from the primary power supply portion 101 is input through the charge detection portion 102 and accumulated. The secondary power supply portion 103 supplies power required for the operation of each portion of the device including the low power consumption state control portion 105, the clocking portion 11 as well as the voltage detection portion 104. As a result, the temporal fluctuation of the power generated by the primary power supply portion 101 is relieved, and stabilized output can be obtained.

The voltage detection portion 104 detects voltage generated by the secondary power supply portion 103 and outputs the detected voltage information to the low power consumption state control portion 105. Specifically, the voltage detection portion 104 drives a sampling circuit connected to the secondary power supply portion 103, thereby detecting signals generated by the circuit.

In the low power consumption state control portion 105, the charge state information is input from the charge detection portion 102, and output information of the power generated by the secondary power supply portion 103 is input from the voltage detection portion 104. When a predetermined condition is satisfied, the low power consumption state control portion 105 outputs oscillation start signals or oscillation stop signals to the clocking portion 11. The condition for outputting the signals will be described later in <The control of clocking portion 11 by low power consumption state control portion 105>.

The operation input portion 106 is a member receiving the operation input of the user for controlling the time display. For example, when the electronic device 1 is a digital wristwatch displaying time by numerical values, the operation input portion 106 is an operation button for starting or stopping the time display. Here, the operation input portion 106 may be an operation button for starting or stopping the time display to drive or stop time adjustment or other functions. Regardless of the type of the operation button, the operation input portion 106 receives the operation of switching between start and stop of the time display, whenever being pressed. When the electronic device 1 is an analogue wristwatch displaying time by the positions of the watch hands, the operation input portion 106 is a winder, for example.

The input state detection portion 107 detects a state of the operation input received by the operation input portion 106, and outputs time display control signals to the clocking control portion 109 configuring the clocking portion 11. For example, when the device is a digital wristwatch, the input state detection portion 107 detects a state where the operation button configuring the operation input portion 106 has been pressed, and outputs the time display control signals to the clocking control portion 109. Whenever the operation button is pressed, the input state detection portion 107 changes the time display control signals into time display stop signals or the time display start signals alternatively.

For example, if the electronic device 1 is an analogue wristwatch, when the winder configuring the operation input portion 106 is pressed so as to be close to the body of the electronic device 1, the input state detection portion 107 outputs the time display start signals to the clocking control portion 109. The input state detection portion 107 outputs the time display stop signals to the clocking control portion 109, when the winder is pulled to be away from the body of the electronic device 1. Incidentally, the input state detection portion 107 uses electric signals of a certain potential (hereinafter, referred to as low potential signals) as the time display start signal, and uses electric signals (high potential signals) of a potential higher than that of the low potential signals as the time display stop signals, for example. That is, the input state detection portion 107 is a circuit which switches the potential of output signals according to the position of a terminal interlocked with the winder. Here, the input state detection portion 107 connects a voltage source (for example, the secondary power supply portion 103) supplying potential at a certain level or higher to the circuit as an input, and outputs the low or high potential signal from the circuit.

The oscillation circuit control portion 108 configuring the clocking portion 11 includes a constant voltage circuit for generating clock signals whose amplitude changes at a fixed period, and outputs the clock signals to the clocking control portion 109. As described later, the clock signals are used to control the operation of the clocking control portion 109. When receiving the input of oscillation start signals from the low power consumption state control portion 105, the oscillation circuit control portion 108 controls the constant voltage circuit to start operation, thereby starting the generation of the clock signals. In addition, when receiving the input of the oscillation stop signals from the low power consumption state control portion 105, the oscillation circuit control portion 108 controls the constant voltage circuit to stop the operation, thereby stopping the generation of the clock signals.

The clocking control portion 109 receives the input of the clock signals from the oscillation circuit control portion 108, and counts the peak number of the amplitude of the clock signals, thereby changing the time information to be displayed per a predetermined peak number at a fixed interval. For example, when the frequency of the clock signals is 32,768 Hz, the clocking control portion 109 increases second information by 1 second whenever 32,768 peaks of the signals are counted. In this manner, the clocking control portion 109 measures the current time or the time elapsed from a certain point of time.

If the electronic device 1 is a digital watch, the clocking control portion 109 displays numerical values showing the measured current time when the clocking control portion 109 receives the input of the time display start signals from the input state detection portion 107. When receiving the input of the time display stop signals from the input state detection portion 107, the clocking control portion 109 stops displaying the current time. When failing to obtain the clock signals from the oscillation circuit control portion 108, the clocking control portion 109 stops the operation.

If the electronic device 1 is an analogue watch, for a period of time when the clocking control portion 109 receives the input of the time display start signals and then receives the input of the time display stop signals from the input state detection portion 107, the clocking control portion 109 changes the position of the watch hand displayed on a dial plate by a fixed amount whenever the peak of the clock signal is counted. That is, whenever counting the peak numbers corresponding to 60 seconds, 60 minutes, and 24 hours, respectively, the input state detection portion 107 moves the second hand, the minute hand, and the hour hand to rotate once, respectively. For a period of time when the clocking control portion 109 receives the input of the time display stop signals and then receives the input of the time display start signals from the input state detection portion 107, the clocking control portion 109 stops moving the positions of the watch hands displayed on the dial plate, thereby making it possible to adjust the displayed time. In the analogue watch, when the winder is pulled and rotated, the minute hand and the hour hand are rotated, whereby the displayed time can be adjusted.

The clocking control portion 109 receives the input of non-charged time measurement start signals, which will be described later, from the low power consumption state control portion 105. When not performing the time display, the clocking control portion 109 measures time (hereinafter, referred to as non-charged time) from a point of time when the non-charged time measurement start signal is received, and outputs a non-charged time measurement stop signal to the low power consumption state control portion 105 when the measured time exceeds a preset time. Moreover, the clocking control portion 109 outputs time display state information showing whether or not the time display is performed to the low power consumption state control portion 105.

<The Control of the Clocking Portion 11 by Low Power Consumption State Control Portion 105>

In the low power consumption state control portion 105, the charge state information is input from the charge detection portion storage portion 102, and the detected voltage information of the secondary power supply portion 103 is input from the voltage detection portion 104. When the charge information shows the charged state, or when the voltage information is higher than a threshold voltage Vc, the low power consumption state control portion 105 outputs the oscillation start signal to the oscillation circuit control portion 108. When receiving the input of the oscillation start signal from the low power consumption state control portion 105, the oscillation circuit control portion 108 outputs the clock signal to the clocking control portion 109. The clocking control portion 109 starts operating when receiving the input of the clock signal from the oscillation circuit control portion 108, and the electronic device 1 starts the time display or time measurement.

Herein, as the voltage information of the secondary power supply portion 103, potential difference from a ground potential as a reference is used; however, potential difference from another reference potential may be used. The threshold voltage Vc is a voltage at least higher than operation limit voltage Vm. The operation limit voltage Vm refers to a minimum voltage required for the operation of the electronic device 1. As the operation limit voltage Vm, a voltage required for the operation of the clocking control portion 109 consuming most of the power of the device for the time display, a voltage required for the oscillation circuit control portion 108 to generate and output the clock signal, or whichever high voltage among these voltages can be used.

When the secondary power supply portion 103 is not in a charged state, the low power consumption state control portion 105 outputs the non-charged time measurement start signal to the clocking control portion 109. Subsequently, after receiving the input of the non-charged time measurement stop signal from the clocking control portion 109, the low power consumption state control portion 105 outputs the oscillation stop signal to the oscillation circuit control portion 108. After receiving the input of the oscillation stop signal from the low power consumption state control portion 105, the oscillation circuit control portion 108 stops outputting the clock signal. The clocking control portion 109 becomes unable to obtain the clock signal from the oscillation circuit control portion 108, and stops its operation.

As described above, after a predetermined time elapses from when the low power consumption state control portion 105 outputs the non-charged time measurement start signal to the clocking control portion 109, the low power consumption state control portion 105 receives the input of the non-charged time measurement stop signal from the clocking control portion 109. The predetermined time is, for example, 10 minutes, but may be shorter or longer than 10 minutes so long as the time is at least sufficient for setting the electronic device 1, such as for adjusting time. In addition, the predetermined time can be set to a time for which the electronic device 1 can continuously operate until the voltage V supplied from the secondary power supply portion becomes equal to or higher than the operation limit voltage Vm.

When the secondary power supply portion 103 is not in the charged state, and when the voltage information of the secondary power supply portion 103 is equal to or lower than the threshold voltage Vc, the low power consumption state control portion 105 outputs the oscillation stop signal to the oscillation circuit control portion 108. When receiving the input of the oscillation stop signal from the low power consumption state control portion 105, the oscillation circuit control portion 108 stops outputting the clock signal to the clocking control portion 109. When the clocking control portion 109 becomes unable to obtain the clock signal from the oscillation circuit control portion 108, the clocking control portion 109 stops its operation.

On the other hand, when the secondary power supply portion 103 is in the charged state, the low power consumption state control portion 105 outputs the oscillation start signal to the oscillation circuit control portion 108. When receiving the input of the oscillation start signal form the low power consumption state control portion 105, the oscillation circuit control portion 108 starts outputting the clock signal to the clocking control portion 109. When receiving the input of the clock signal from the oscillation circuit control portion 108, the clocking control portion 109 starts its operating.

Figure 2:
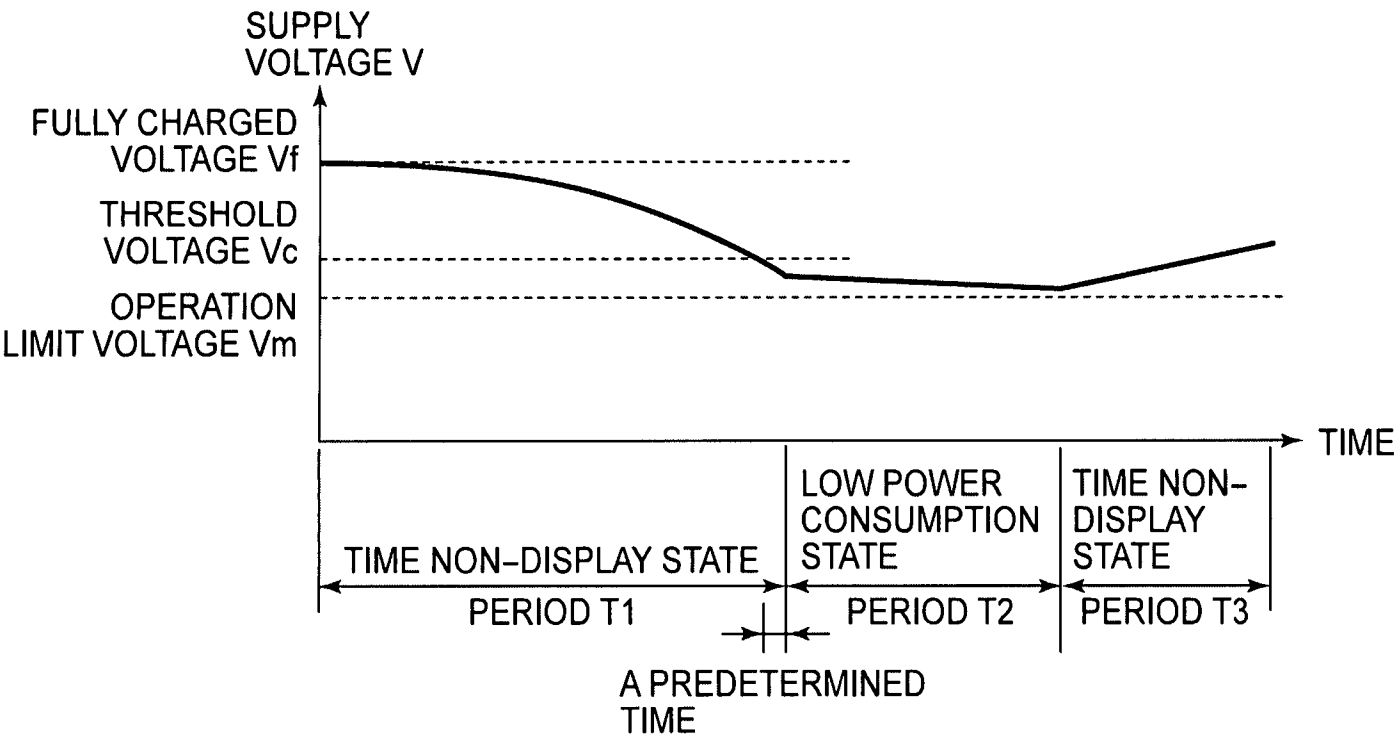
FIG. 2 is a schematic view illustrating an example of an output voltage from a secondary power supply portion in the electronic device according to the embodiment.

FIG. 2 illustrates an example of the temporal change of the voltage supplied from the secondary power supply portion 103. In FIG. 2, a horizontal axis represents time, and a vertical axis represents a supply voltage V. FIG. 2 shows a state where the secondary power supply portion 103 initially stores charge satisfying its own capacity. At this time, the voltage supplied from the secondary power supply portion 103 is called a fully charged voltage Vf, which is, for example, 1.8 V. FIG. 2 shows that the supply voltage of the secondary power supply portion 103 is gradually reduced due to power consumption even when the time non-display state (see FIG. 3, 202) is continued in which the clocking control portion 109 outputs the clock signal while the electronic device 1 does not perform the time display (period T1).

FIG. 2 illustrates that, if the supply voltage V from the secondary power supply portion 103 becomes equal to or lower than the threshold voltage Vc, the operation of the clocking control portion 109 is stopped after a predetermined time elapses, whereby the electronic device 1 gets into the low power consumption state (see FIG. 3, 203) (period T2). The threshold voltage Vc is 1.1 V, for example, which is higher than the operation limit voltage Vm (1.0 V, for example). The predetermined time until the operation of the clocking control portion 109 is stopped is set such that the output voltage V from the secondary power supply portion at the time when the operation of the clocking control portion 109 is stopped becomes at least higher than the operation limit voltage Vm. In the low power consumption state, the overall power consumption amount of the electronic device 1 is markedly reduced compared to the normal operation state (see FIG. 3, 201). It is desirable to store the electronic device in this state during shipment or transport in which time display is not required.

When the secondary power supply portion 103 gets charged, the clocking control portion 109 operates again. The power generated by the charging is considerably greater than the power consumed by the device in general, so that the power is accumulated in the secondary power supply portion 103. As a result, the supply voltage V from the secondary power supply portion 103 also increases (period T3). In this manner, the supply of power from the secondary power supply portion 103 which is required for operating the device is guaranteed in the device.

In the embodiment, the difference between the threshold voltage Vc and the operation limit voltage Vm is set to 0.1 V, that is, about 10% of the operation limit voltage Vm, and about 6% of the fully charged voltage Vf. However, the invention is not limited thereto, and the difference may be smaller or larger than these values. In addition, the supply voltage V of the secondary power supply portion 103, which is yielded from the state of the fully charged voltage Vf after the electronic device 1 is continuously operated for a preset time in the normal operation state or the time display state, may be set to the threshold voltage Vc. Moreover, the supply voltage V yielded when the temporal change of the supply voltage V of the secondary power supply portion 103 has reached a preset value may be set to the threshold voltage Vc.

Figure 3:
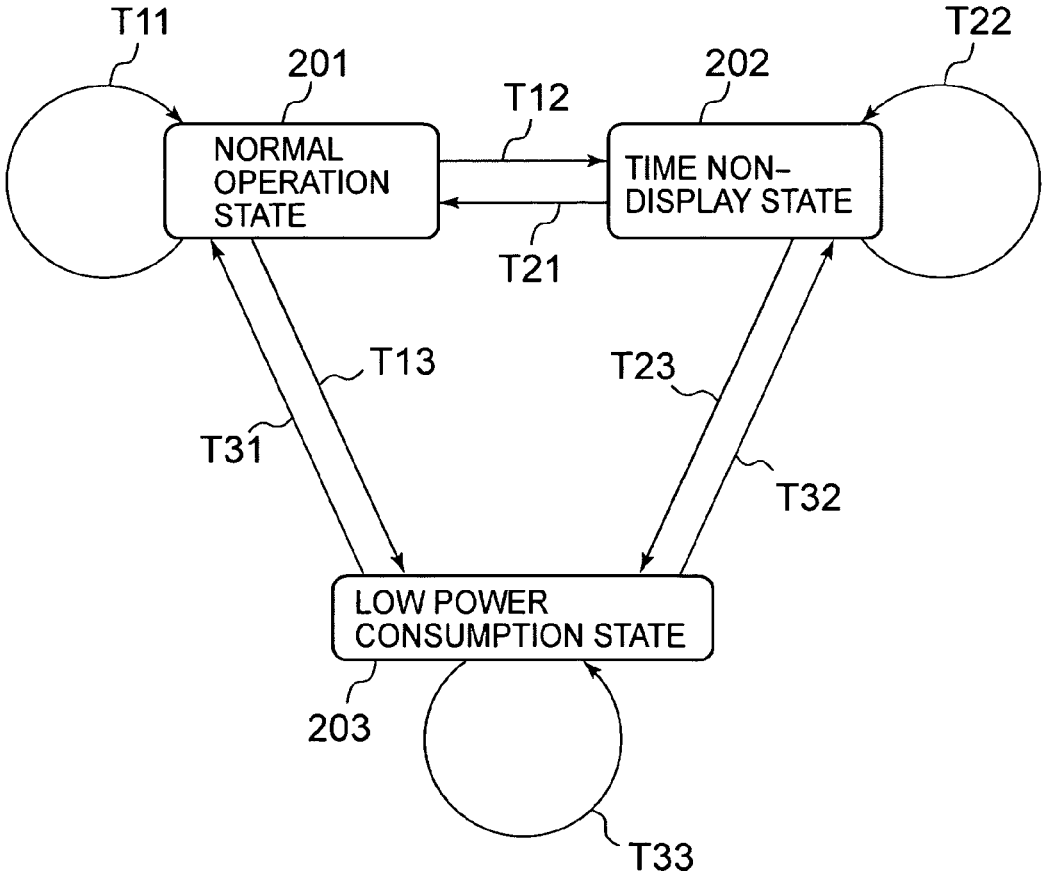
FIG. 3 is a schematic block diagram illustrating the transition of an operation state by a control method of the electronic device according to the embodiment.

FIG. 3 is a schematic block diagram showing the transition of the operation state by the control method of the electronic device 1 according to the embodiment. The operation state of the electronic device 1 include a normal operation state 201, a time non-display state 202, and a low power consumption state 203, for example. The normal operation state 201 refers to a state where the device measures the time and displays the measured time. The time non-display state 202 refers to a state where the device does not display the measured time though the clock signal is generated. However, the time non-display state 202 is a state where the operation other than the time display is performed in the device. In the time non-display state 202, the electronic device 1 can suppress the power consumption required for the time display. The low power consumption state 203 refers to a state where the operation of the device is stopped without generating the clock signal.

In the low power consumption state 203, the electronic device 1 consumes only an extremely small amount of minimum required power. That is, the electronic device 1 consumes only the power required for the charge detection portion 102 to detect the charged state of the secondary power supply portion 103, the power required for the voltage detection portion 104 to detect the state of the voltage supplied from the secondary power supply portion, and the power required for the low power consumption state control portion 105 to output the oscillation start signal to the oscillation circuit control portion 108 after receiving the outputs from the charge detection portion 102 and the secondary power supply portion 103. Accordingly, by the transition of the electronic device 1 to the low power consumption state 203, it is possible to prevent the secondary power supply portion 103 from being put in the overdischarged state.

As shown in FIG. 3, the transitions among the operation states by the control method of the electronic device 1 include 9 cases: a case where the normal operation state 201 does not change (T11); a transition from the normal operation state 201 to the time non-display state 202 (T12); a transition from the normal operation state 201 to the low power consumption state 203 (T13); a transition from the time non-display state 202 to the normal operation state 201 (T21); a case where the time non-display state 202 does not change (T22); a transition from the time non-display state 202 to the low power consumption state 203 (T23); a transition from the low power consumption state 203 to the normal operation state 201 (T31); a transition from the low power consumption state 203 to the time non-display state 202 (T32); and a case where the low power consumption state 203 does not change (T33).

Figure 4:
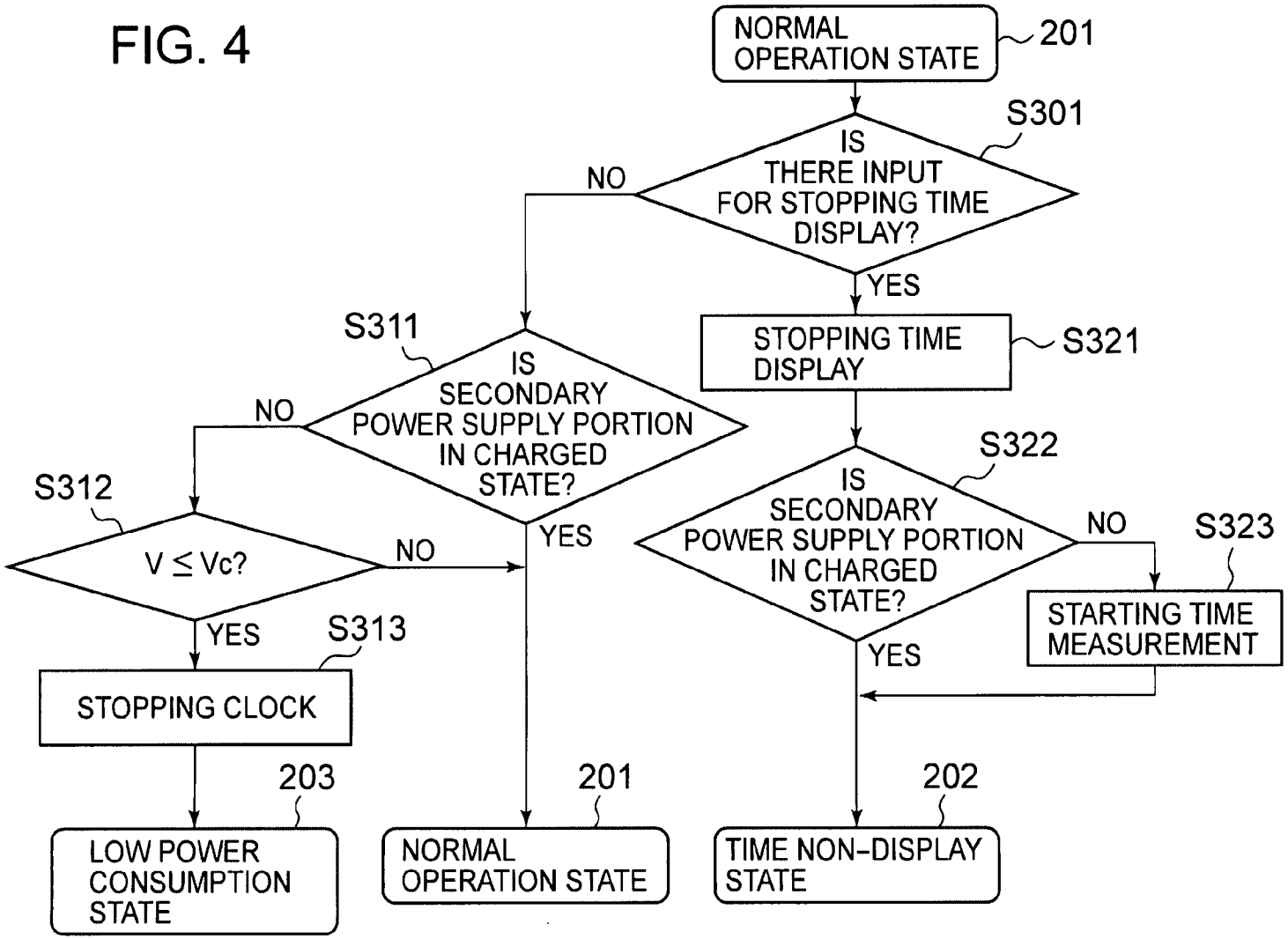
FIG. 4 is a flowchart illustrating an example of the operation relating to the transition from a normal operation state to each operation state by the control method of the electronic device according to the embodiment.

FIG. 4 is a flowchart illustrating an example of the operation in the control method of the electronic device 1, specifically, an example of the operation relating to the transitions (T11, T12, and T13) from the normal operation state 201 to each of the operation states 201 to 203.

When the electronic device 1 is in the normal operation state 201, the operation input portion 106 receives the operation input of the user, and the input state detection portion 107 detects the operation input state. The input state detection portion 107 determines whether or not there has been an input for stopping the time display based on the detection result (S301). When the input state detection portion 107 determines that there has been an input for stopping the time display (S301, Y), the oscillation circuit control portion 108 outputs the time display stop signal to the clocking control portion 109. When receiving the input of the time display stop signal from the oscillation circuit control portion 108, the clocking control portion 109 stops the time display (S321).

The charge detection portion 102 determines whether or not the secondary power supply portion 103 is in the charged state (S322). When the secondary power supply portion 103 is determined to be in the charged state (S322 Y), the charge detection portion 102 outputs the information of this determination result to the low power consumption state control portion 105. Even when receiving the input of the information of this determination result from the charge detection portion 102, the low power consumption state control portion 105 does not particularly change the operation state. That is, the operation state of the electronic device 1 transits to the time non-display state 202 (see FIG. 3, T12).

On the other hand, when determining that the secondary power supply portion 103 is not in the charged state (S322 N), the charge detection portion 102 outputs the information of this determination result to the low power consumption state control portion 105. When receiving the input of the information of this determination result from the charge detection portion 102, the low power consumption state control portion 105 outputs the non-charged time measurement start signal to the clocking control portion 109. The clocking control portion 109 receives the input of the non-charged time measurement start signal from the low power consumption state control portion 105, and starts measuring the non-charged time from the point of time of the input (S323). At this point of time, the operation of the clocking control portion 109 is continued. That is, the operation state of the electronic device 1 transits to the time non-display state 202 (see FIG. 3, T12).

When determining that there has not been an input for stopping the time display (S301, N), the input state detection portion 107 does not output the time display stop signal to the clocking control portion 109. When detecting the secondary power supply portion 103 is in the charged state, the charge detection portion 102 outputs the information of this detection result to the low power consumption state control portion 105. The low power consumption state control portion 105 determines whether or not the information of this detection result has been input from the charge detection portion 102 (S311). Even when the information of this detection result has been input from the charge detection portion 102 (S311 Y), the low power consumption state control portion 105 does not change the operation state. That is, the operation state of the electronic device 1 is retained in the normal operation state 201 (see FIG. 3, T11).

When detecting that the secondary power supply portion is not in the charged state, the charge detection portion 102 outputs the information of this detection result to the low power consumption state control portion 105 (S311). When receiving the input of the information of this detection result from the charge detection portion 102 (S311, N), the low power consumption state control portion 105 determines whether or not the voltage information V from the voltage detection portion 104 is equal to or lower than the threshold voltage Vc (S312). When determining that the voltage information is not equal to or lower than the threshold voltage Vc (S312 N), the low power consumption state control portion 105 does not change the operation state. That is, the operation state of the electronic device 1 is retained in the normal operation state 201 (see FIG. 3, T11).

When determining that the voltage information is equal to or lower than the threshold voltage Vc (S312 Y), the low power consumption state control portion 105 outputs the oscillation stop signal to the oscillation circuit control portion 108. When receiving the input of the oscillation stop signal from the low power consumption state control portion 105, the oscillation circuit control portion 108 stops generating the clock signal and outputting the clock signal to the clocking control portion 109 (S313). Accordingly, the operation state of the electronic device 1 transits to the low power consumption state 203 (see FIG. 3, T13).

On the other hand, when determining that the voltage information V is higher than the threshold voltage Vc (S312 N), the low power consumption state control portion 105 does not change the operation state. Accordingly, the operation state of the electronic device 1 is retained in the normal operation state 201 (see FIG. 3, T11).

Figure 5:
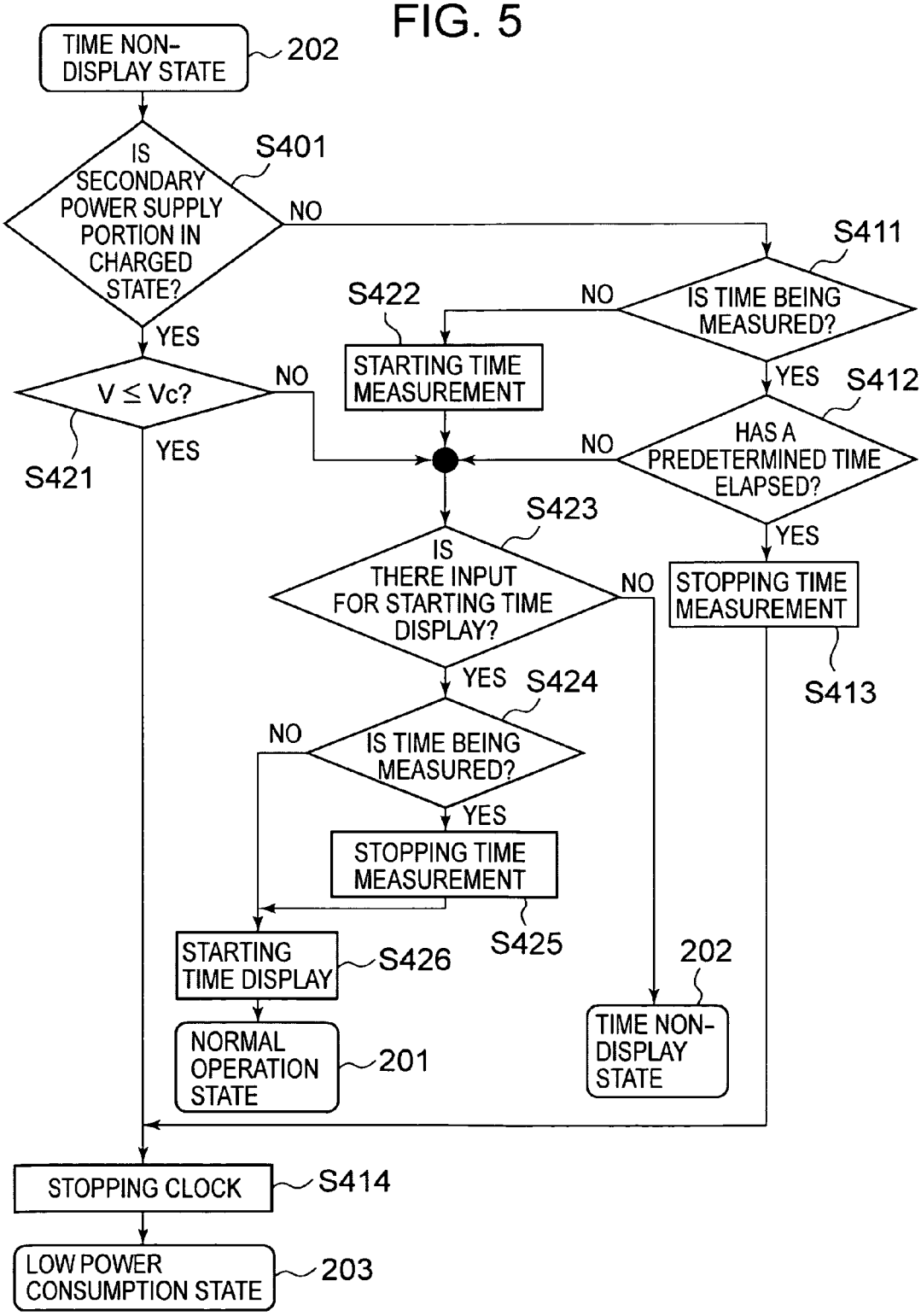
FIG. 5 is a flowchart illustrating an example of the operation relating to the transition from a time non-display state to each operation state by the control method of the electronic device according to the embodiment.

FIG. 5 is a flowchart illustrating an example of the operation in the control method of the electronic device 1, specifically, the operation relating to the transitions (T21, T22, and T23) from the time non-display state 202 to each of the operation states 201 to 203.

When the electronic device 1 is in the time non-display state 202, the charge detection portion 102 detects whether or not the secondary power supply portion 103 is in the charged state (S401). When detecting the secondary power supply portion 103 is in the charged state (S401 Y), the charge detection portion 102 outputs the information of this detection result to the low power consumption state control portion 105. The low power consumption state control portion 105 receives the input of the voltage information of the secondary power supply portion 103 detected by the voltage detection portion 104, and determines whether or not the voltage information V is equal to or lower than the threshold voltage Vc (S421). When the low power consumption state control portion 105 determines that the voltage information V is equal to or lower than the threshold voltage Vc (S421 Y), the process moves on to S414. When the low power consumption state control portion 105 determines that the voltage information V is not equal to or lower than the threshold voltage Vc (S421 N), the process moves on to S423.

On the other hand, when detecting the secondary power supply portion 103 is not in the charged state (service center 401 N), the charge detection portion 102 outputs the information of this detection result to the low power consumption state control portion 105. When receiving the input of the information of this detection result from the charge detection portion 102, the low power consumption state control portion 105 determines whether or not the clocking control portion 109 is measuring the non-charged time (S411). Herein, the low power consumption state control portion 105 can determine that the clocking control portion 109 is measuring the non-charged time based on a fact that the low power consumption state control portion 105 has output the non-charged time measurement start signal to the clocking control portion 109.

When determining that the clocking control portion 109 is not measuring the non-charged time (S411 N), the low power consumption state control portion 105 outputs the non-charged time measurement start signal to the clocking control portion 109. After receiving the input of the non-charged time measurement start signal from the low power consumption state control portion 105, the clocking control portion 109 starts measuring the non-charged time (S422), and the process moves on S423.

When determining that the clocking control portion 109 is measuring the non-charged time (S411 Y), the low power consumption state control portion 105 determines whether or not a predetermined time has elapsed from the starting point of the non-charged time measurement (S412). The low power consumption state control portion 105 can determine that the predetermined time has elapsed from the starting point of the non-charged time measurement, based on a fact that the low power consumption state control portion 105 has received the input of the non-charged time measurement stop signal from the clocking control portion 109. When the low power consumption state control portion 105 determines that the predetermined time has elapsed (S412 Y), the clocking control portion 109 gets into a state where the non-charged time measurement has been stopped (S413). After receiving the input of the non-charged time measurement start signal from the low power consumption state control portion 105, the clocking control portion 109 starts measuring the non-charged time, and stops measuring the non-charged time when the measurement time reaches a predetermined time. This is because the clocking control portion 109 outputs the non-charged time measurement stop signal to the low power consumption state control portion 105 at this time.

Herein, there is a possibility that the low power consumption state control portion 105 outputs the non-charged time measurement start signal again after receiving the input of the non-charged time measurement stop signal. In this case, there is a risk that the low power consumption state control portion 105 can not accurately determine whether or not the non-charged time is being measured and whether or not the predetermined time has elapsed. In the present example, after receiving the input of the non-charged time measurement stop signal after outputting the non-charged time measurement start signal, the low power consumption state control portion 105 determines that the predetermined time has elapsed (S412) and deletes the information showing that the non-charged time measurement start signal has been output as well as the information showing that the non-charged time measurement stop signal has been input. As a result, the low power consumption state control portion 105 can accurately determine that the non-charged time is not being measured, after the end of the non-charged time.

After the non-charged time measurement is stopped in the clocking control portion 109 (S413), the low power consumption state control portion 105 outputs the oscillation stop signal to the oscillation circuit control portion 108. When receiving the input of the oscillation stop signal from the low power consumption state control portion 105, the oscillation circuit control portion 108 stops generating the clock signal and outputting the signal to the clocking control portion 109 (S414). Accordingly, the operation state of the electronic device 1 transits to the low power consumption state 203 (see FIG. 2, T23).

The input state detection portion 107 detects whether or not there has been an input of the time display start signal (S423). When the input of the time display start signal is detected (S423 Y), the low power consumption state control portion 105 determines whether or not the clocking control portion 109 is measuring the non-charged time (S424). When determining that the clocking control portion 109 is measuring the non-charged time (S424 Y), the low power consumption state control portion 105 outputs the non-charged time measurement stop signal to the clocking control portion 109. The clocking control portion 109 receives the input of the non-charged time measurement stop signal from the low power consumption state control portion 105, and stops measuring the non-charged time (S425). After the non-charged time measurement is stopped (S425), or when it is determined that the clocking control portion 109 is measuring the non-charged time (S424 N), the clocking control portion 109 starts time display (S426). Accordingly, the operation state of the electronic device 1 transits to the normal operation state 201 (see FIG. 2, T21).

When the input state detection portion 107 does not detect the input of the time display start signal (S423 N), the operation states of both the clocking control portion 109 and the low power consumption state control portion 105 do not change. Accordingly, the operation state of the electronic device 1 is retained in the time non-display state 202 (see FIG. 2, T22).

Figure 6:
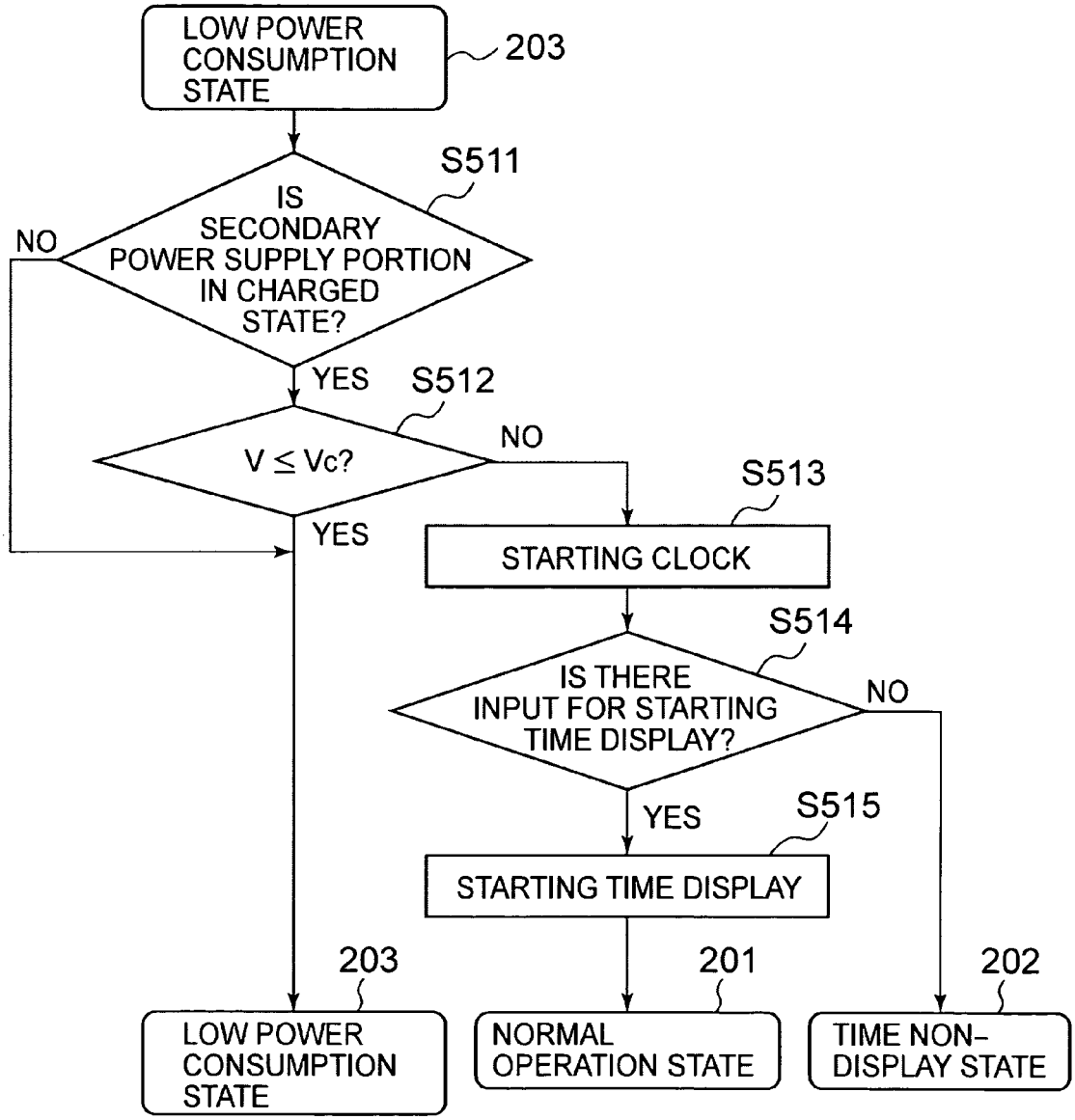
FIG. 6 is a flowchart illustrating an example of the operation relating to the transition from a low power consumption state to each operation state by the control method of the electronic device according to the embodiment.

FIG. 6 is a flowchart illustrating an example of the operation in the control method of the electronic device 1, specifically, the operation relating to the transitions (T31, T32, and T33) from the low power consumption state 203 to each of the operation states 201 to 203.

When the electronic device 1 is in the low power consumption state 203, the charge detection portion 102 detects whether or not the secondary power supply portion is in the charged state (S511). When the secondary power supply portion is detected not to be in the charged state, the charge detection portion 102 outputs the information of this detection result to the low power consumption state control portion 105 (S511 N). At this time, the low power consumption state control portion 105 does not change the operation state. Accordingly, the operation state of the electronic device 1 is retained in the low power consumption state 203 (see FIG. 2, T33).

When the secondary power supply portion is detected to be in the charged state, the charge detection portion 102 outputs the information of this detection result to the low power consumption state control portion 105 (S511 Y). The low power consumption state control portion 105 receives the input of the voltage information of the secondary power supply portion 103 detected by the voltage detection portion 104, and determines whether the voltage information V is equal to or lower than the threshold voltage Vc (S512). When determining that the voltage information V is equal to or lower than the threshold voltage Vc (S512 Y), the low power consumption state control portion 105 does not change the operation state. Accordingly, the operation state of the electronic device 1 is retained in the low power consumption state 203 (see FIG. 2, T33).

When determining that the voltage information V is not equal to or lower than the threshold voltage Vc (S512 N), the low power consumption state control portion 105 outputs the oscillation start signal to the oscillation circuit control portion 108. When receiving the input of the oscillation start signal from the low power consumption state control portion 105, the oscillation circuit control portion 108 start generating the clock signal and outputs the signal to the clocking control portion 109 (S513).

The input state detection portion 107 detects whether or not there has been an input of the time display start signal (S514). When the input state detection portion 107 does not detect the input of the time display start signal (S514 N), the low power consumption state control portion 105 does not particularly change the operation state. The clocking control portion 109 operates without performing the time display. Accordingly, the operation state of the electronic device 1 transits to the time non-display state 202 (see FIG. 2, T32).

When the input state detection portion 107 detects that there has been an input of the time display start signal (S514 Y), the low power consumption state control portion 105 outputs the time display start signal to the clocking control portion 109. When receiving the input of the time display start signal from the input state detection portion 107, the clocking control portion 109 starts time display (S515). Accordingly, the operation state of the electronic device 1 transits to the normal operation state 201 (see FIG. 2, T31).

In S514, a configuration can be considered in which the input state detection portion 107 stores time display state information obtained immediately before the operation state of the electronic device 1 transits to the low power consumption state 203 from the previous normal operation state 201 or the time non-display state 202, and the time display state information is output to the clocking control portion 109. The time display state information is the information showing whether or not the time display is being performed, for example. When receiving the input of the time display state information, the clocking control portion 109 performs the time display based on this state. Accordingly, the electronic device 1 operates in the time display state operated by the user immediately before the operation state transits to the low power consumption state 203.

In this manner, the electronic device 1 according to the embodiment includes the primary power supply portion 101 generating power by converting the first energy into the electric energy as the second energy, the secondary power supply portion 103 storing the electric energy obtained by the power generation, the charge detection portion 102 detecting the state where the secondary power supply portion is not charged with the electric energy, the clocking portion 11 clocking time and stopping the display of the clocked time when the operation input is detected, and the low power consumption state control portion 105 which measures a time of a state where the operation input is detected and the charging is not performed and stops the operation of the clocking portion when the measured time exceeds a preset time.

Consequently, in the electronic device 1, when the operation input for stopping the time display is detected, and then the time elapsed from when the secondary power supply portion is not charged with the electric energy generated by the primary power supply portion reaches a preset time, the operation of the clocking portion is stopped. Accordingly, the electronic device 1 can solve the problem that the user cannot check time due to the operation stop of the clocking portion 11 against the user's will. That is, it is possible to make the user have a sufficient time to check the time display.

The electronic device 1 according to the embodiment further includes the voltage detection portion 104 detecting the supply voltage of the secondary power supply portion, wherein the charge detection portion 102 detects a state where the secondary power supply portion is charged with the electric energy, and the low power consumption state control portion 105 stops the operation of the clocking portion 11 when the supply voltage of the secondary power supply portion is higher than a voltage required for the operation of the device, and starts the operation of the clocking portion 11 when the charged state is detected.

Therefore, according to the electronic device 1, when the supply voltage of the secondary power supply portion 103 is higher than the voltage required for the operation, the operation of the clocking portion 11 is stopped, and when the charged state is detected, the operation of the clocking portion 11 is started. As a result, it is possible to prevent the supply voltage of the secondary power supply portion 103 from becoming lower than the voltage required for the operation of the device, and to start the operation immediately when the charged state is detected.

The electronic device 1 according to the embodiment is characterized in that the operation state established when the operation of the clocking portion 11 is started is selected according to the operation state established before the low power consumption state control portion 105 stops the operation of the clocking portion 11.

Accordingly, in the electronic device 1, it is possible to avoid a problem that the operation is started in an operation state which is different from a state established when the operation was stopped against the user's will.

The electronic device 1 according to the embodiment is characterized in that the clocking portion 11 is configured with the clocking control portion 109 and the oscillation circuit control portion 108 for generating the clock signals to drive the clocking control portion 109, and that the operation of the clocking portion 11 is stopped when the oscillation circuit control portion 108 stops generating the clock signal.

As a result, it is possible to control the start or stop of the operation of the clocking portion 11 by instructing the oscillation circuit control portion 108 to start or stop generating the clock signal.

Second Embodiment

Next, the second embodiment will be described in detail with reference to the drawings.

Figure 7:
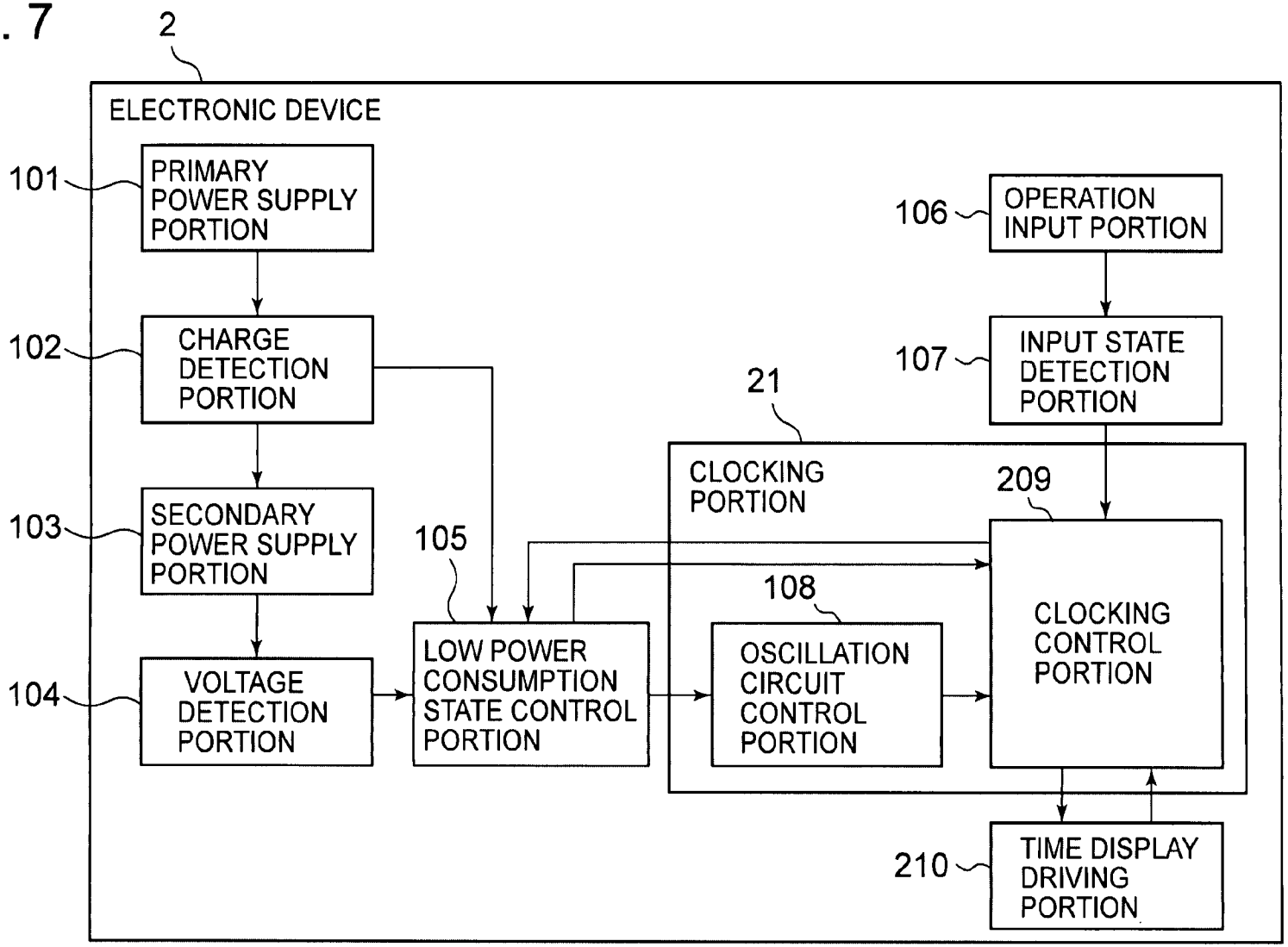
FIG. 7 is a schematic block diagram of an electronic device according to a second embodiment of the invention.

FIG. 7 illustrates the configuration of an electronic device 2 according to the embodiment.

The electronic device 2 is an example of an analogue watch displaying measured time by using motor-driven watch hands on a dial plate.

The electronic device 2 is configured with the primary power supply portion 101, the charge detection portion 102, the secondary power supply portion 103, the voltage detection portion 104, the low power consumption state control portion 105, the operation input portion 106, the input state detection portion 107, a clocking portion 21, and a time display driving portion 210. The clocking portion 21 is configured with the oscillation circuit control portion 108 and a clocking control portion 209.

Accordingly, the electronic device 2 is different from the electronic device 1 in that the electronic device 2 is provided with the clocking control portion 209 instead of the clocking control portion 109 and further includes the time display driving portion 210.

In the following description, the difference of the electronic device 2 from the electronic device 1 will be mainly described.

Figure 8:
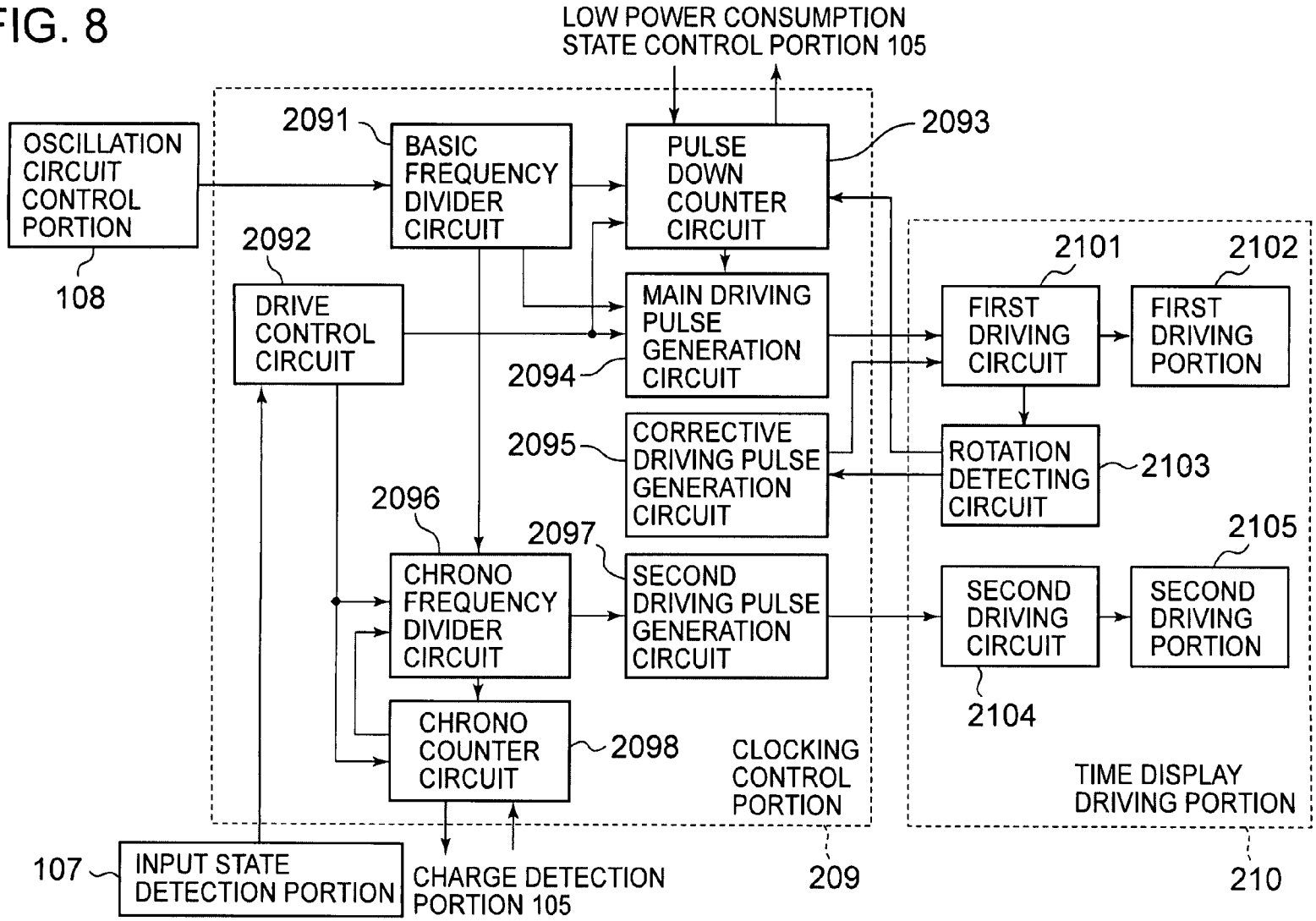
FIG. 8 is a schematic block diagram of a clocking control portion and a time display driving portion according to the embodiment.

FIG. 8 illustrates an example of the clocking control portion 209 and the time display driving portion 210 according to the embodiment.

The clocking control portion 209 is configured with a basic frequency divider circuit 2091, a drive control circuit 2092, a pulse down counter circuit 2093, a main driving pulse generation circuit 2094, a corrective driving pulse generation circuit 2095, a chronograph frequency divider circuit 2096, a second driving pulse generation circuit 2097, and a chronograph counter circuit 2098.

The time display driving portion 210 is configured with a first driving circuit 2101, a first driving portion 2102, a rotation detecting circuit 2103, a second driving circuit 2104, and a second driving portion 2105.

The basic frequency divider circuit 2091 generates driving excitation signals by performing frequency division on the clock signal input from the oscillation circuit control portion 108. For example, when the clock signal input from the oscillation circuit control portion 108 is a pulse signal at a frequency of 32,768 ($2^{15}$) Hz, the basic frequency divider circuit 2091 performs 15 stages of frequency division on the clock signal, thereby generating the pulse signal at 1 Hz as the driving excitation signal. The basic frequency divider circuit 2091 outputs the generated driving excitation signal to the main driving pulse generation circuit 2094.

The basic frequency divider circuit 2091 performs the frequency division on the clock signal input from the oscillation circuit control portion 108, thereby generating chronograph excitation signals. However, the stage number of the frequency division for generating the chronograph excitation signal by the basic frequency divider circuit 2091 is made lower than the stage number in the case of generating the driving excitation signal. For example, when the clock signal input from the oscillation circuit control portion 108 is the pulse signal at 32,768 ($2^{15}$) Hz, the basic frequency divider circuit 2091 performs 7 stages of frequency division on the clock signal, thereby generating the pulse signal at 256 ($2^{8}$) Hz as the chronograph excitation signal. The basic frequency divider circuit 2091 outputs the generated chronograph excitation signal to the chronograph frequency divider circuit 2096.

The basic frequency divider circuit 2091 performs the frequency division on the clock signal input from the oscillation circuit control portion 108 in a higher stage number compared to a case of generating the driving excitation signal, thereby generating a PCD (Pulse Countdown Signal; pulse countdown) signal. The frequency of the PCD signal is an integral multiple (for example, 4 times) of the frequency of the main driving excitation signal. The basic frequency divider circuit 2091 outputs the generated PCD signals to the pulse down counter circuit 2093.

Herein, the pulse down means to rank down (level down) the driving pulse signal described later and is also called rank down. On the other hand, the pulse up means to rank up the driving pulse described later and is also called rank up.

The rank of the driving pulse shows the magnitude of its energy. For example, a rank n of a main driving pulse P1*n* is any value from a minimum value 1 to a maximum value m (for example, m=2) in the embodiment. The larger (higher) the value of the rank n, the bigger the energy. For example, provided that the amplitude value is constant, the higher the rank is, the longer the peak value (pulse width) of each pulse configuring the driving pulse signal lasts. On the other hand, the lower the rank, the shorter the pulse width of the driving pulse signal.

Pulse down count means to count the amplitude peak number of the PCD signal until the pulse down is instructed.

When the time display start signal is input from the input state detection portion 107, the drive control circuit 2092 generates the pulse count start signal and the driving pulse generation signal. The pulse count start signal is a signal instructing the start of counting the amplitude peak number of the driving pulse signal. The pulse generating signal is a signal instructing the generation of the driving pulse signal. The drive control circuit 2092 outputs the generated pulse count start signal to the pulse down counter circuit 2093 and the chronograph counter circuit 2098. The drive control circuit 2092 outputs the generated driving pulse generation signal to the main driving pulse generation circuit 2094 and the chronograph frequency divider circuit 2096.

When the time display stop signal is input from the input state detection portion 107, the drive control circuit 2092 generates the pulse count stop signal and the driving pulse stop signal. The pulse count stop signal is a signal instructing the stop of counting the amplitude peak number of the driving pulse signal. The driving pulse stop signal is a signal instructing the stop of generating the driving pulse signal. The drive control circuit 2092 outputs the generated pulse count stop signal to the pulse down counter circuit 2093 and the chronograph counter circuit 2098. The drive control circuit 2092 outputs the generated driving pulse stop signal to the main driving pulse generation circuit 2094 and the chronograph frequency divider circuit 2096.

In the embodiment, a reset signal may be output to the drive control circuit 2092 based on the operation input state detected by the input state detection portion 107. The reset signal is a signal instructing the change (reset) of the time display (chronograph) showing the time elapsed from a certain point of time into a display showing a preset reference time (for example, 0 second).

When the reset signal is input from the input state detection portion 107, the drive control circuit 2092 outputs a pulse reset signal to the chronograph counter circuit 2098. The pulse reset signal is a signal instructing the change of the amplitude peak number of the counted driving pulse into a predetermined reference value (for example, 0).

When a non-rotation signal showing that the first driving portion 2102 is not operating is input, the pulse down counter circuit 2093 outputs a pulse up signal to the main driving pulse generation circuit 2094. The pulse up signal is a signal instructing the pulse up of the driving pulse. At the same time, the pulse down counter circuit 2093 resets the counted value (described later) to 0.

When the pulse count start signal is input from the drive control circuit 2092, the pulse down counter circuit 2093 counts (pulse down counts) the amplitude peak number of the PCD signal input from the basic frequency divider circuit 2091. When the counted value reaches a value corresponding to a preset time (for example, 80 to 160 seconds), the pulse down counter circuit 2093 outputs a pulse down signal to the main driving pulse generation circuit 2094. The pulse down signal is a signal instructing the pulse down of the driving pulse.

When the pulse count stop signal is input from the drive control circuit 2092, the pulse down counter circuit 2093 stops the pulse down count.

After the non-charged time measurement start signal is input from the low power consumption state control portion 105, the pulse down counter circuit 2093 counts the amplitude peak number of the PCD signal input from the basic frequency divider circuit 2091. When the counted value reaches a value corresponding to a predetermined time (for example, 120 seconds), the pulse down counter circuit 2093 outputs the non-charged time measurement stop signal to the low power consumption state control portion 105. The predetermined time is the time until the oscillation circuit control portion 108 is caused to stop generating the clock signal while the secondary power supply portion 103 is not in the charged state, as described above (see step S412).

When the driving pulse generation signal is input from the drive control circuit 2092, the main driving pulse generation circuit 2094 generates a main driving pulse signal based on the driving excitation signal input from the basic frequency divider circuit 2091. The frequency of the main driving pulse signal generated by the main driving pulse generation circuit 2094 is 1 second, for example.

When the pulse up signal is input from the pulse down counter circuit 2093, the main driving pulse generation circuit 2094 ranks up the generated main driving pulse signal to be generated by one rank, for example. In the embodiment, in order to rank up the main driving pulse signal, the main driving pulse generation circuit 2094 lengthens the pulse width of the main driving pulse signal by a preset time.

When the pulse down signal is input from the pulse down counter circuit 2093, the main driving pulse generation circuit 2094 ranks down the main driving pulse signal to be generated by one rank, for example. In the embodiment, in order to rank down the main driving pulse signal, the main driving pulse generation circuit 2094 shortens the pulse width of the main driving pulse signal by a preset time.

The main driving pulse generation circuit 2094 outputs the generated main driving pulse signal to the first driving circuit 2101.

Based on the main driving pulse signal input from the main driving pulse generation circuit 2094, or the corrective driving pulse signal input from the corrective driving pulse generation circuit 2095, the first driving circuit 2101 generates the driving signal for operating the first driving portion 2102.

The first driving circuit 2101 detects an inductive voltage signal which is generated by the operation of the first driving portion 2102, and outputs the detected inductive voltage signal to the rotation detecting circuit 2103.

The first driving portion 2102 operates based on the driving signal supplied from the first driving circuit 2101. The first driving portion 2102 is, for example, a motor rotating the second hand (time display portion) around the axis included in a clocking device 2 on the dial plate. When the driving signal is a signal generated based on the driving pulse signal having a frequency of 1 second, for example, the first driving portion 2102 drives the second hand every second.

Based on the voltage value shown by the inductive voltage signal input from the first driving circuit 2101, the rotation detecting circuit 2103 determines whether or not the first driving portion 2102 is operating. When the voltage value is smaller than a preset voltage value, for example, the rotation detecting circuit 2103 determines that the first driving portion 2102 is not operating, and generates a non-rotation signal. The rotation detecting circuit 2103 outputs the generated non-rotation signal to the pulse down counter circuit 2093 and the corrective driving pulse generation circuit 2095.

When the non-rotation signal is input from the rotation detecting circuit 2103, the corrective driving pulse generation circuit 2095 generates a corrective driving pulse signal. The amount of the energy of the corrective driving pulse signal generated by the corrective driving pulse generation circuit 2095 is sufficient to operate the first driving portion 2102. Accordingly, the corrective driving pulse generation circuit 2095 generates the corrective driving pulse signal having at least a broader pulse width compared to the main driving pulse signal generated by the main driving pulse generation circuit 2094. The corrective driving pulse generation circuit 2095 outputs the generated corrective driving pulse signal to the first driving circuit 2101.

When the driving pulse generation signal is input from the drive control circuit 2092, the chronograph frequency divider circuit 2096 performs the frequency division on a chronograph excitation signal input from the basic frequency divider circuit 2091, thereby generating a second driving pulse generation signal. The frequency of the generated second driving pulse generation signal is 10 Hz, for example. As a result, the electronic device 2 measures time with an accuracy of 0.1 second.

The chronograph frequency divider circuit 2096 outputs the generated second driving pulse generation signal to the second driving pulse generation circuit 2097 and the chronograph counter circuit 2098.

When the driving pulse stop signal is input from the drive control circuit 2092 or the chronograph counter circuit 2098, the chronograph frequency divider circuit 2096 stops generating the second driving pulse signal.

Based on the second driving pulse generation signal input from the chronograph frequency divider circuit 2096, the second driving pulse generation circuit 2097 generates the second driving pulse signal.

The second driving pulse generation circuit 2097 outputs the generated second driving pulse signal to the second driving circuit 2104.

Based on the second driving pulse signal input from the second driving pulse generation circuit 2097, the second driving circuit 2104 generates a second driving signal for operating the second driving circuit 2104.

The second driving portion 2105 operates based on the second driving signal supplied from the second driving circuit 2104. The second driving portion 2105 is, for example, a motor rotating a display hand (time display portion) around an axis different from the axis of the second hand included in the first driving portion 2102 on the dial plate. When the driving signal is a signal based on the second driving pulse signal having a frequency of 0.1 second, for example, the second driving portion 2105 drives the display hand every 0.1 second.

When the pulse count start signal is input from the drive control circuit 2092, the chronograph counter circuit 2098 starts counting the amplitude peak number (referred to as a chronograph peak number) of the second driving pulse generation signal input from the chronograph frequency divider circuit 2096.

When the chronograph peak number reaches a peak number corresponding to a preset time (for example, 60 minutes), the chronograph counter circuit 2098 stops counting the chronograph peak number.

When the pulse count stop signal is input from the drive control circuit 2092, the chronograph counter circuit 2098 stops counting the chronograph peak number.

When the pulse reset signal is input from the drive control circuit 2092, the chronograph counter circuit 2098 stops counting the chronograph peak number and changes the counted chronograph peak number to a predetermined reference value (for example, 0).

When stopping counting the chronograph peak number, the chronograph counter circuit 2098 generates the driving pulse stop signal and outputs the generated driving pulse stop signal to the chronograph frequency divider circuit 2096.

After the non-charged time measurement start signal is input from the low power consumption state control portion 105, the chronograph counter circuit 2098 starts counting the amplitude peak number (that is, the chronograph peak number) of the second driving pulse generation signal input from the chronograph frequency divider circuit 2096. When the counted value reaches a value corresponding to a predetermined time (for example, 120 seconds), the chronograph counter circuit 2098 outputs the non-charged time measurement stop signal to the low power consumption state control portion 105. The predetermined time is a time until the oscillation circuit control portion 108 is caused to stop generating the clock signal while the secondary power supply portion 103 is not in the charged state, as described above (see step S412).

In the above description, a case was exemplified in which the pulse down counter circuit 2093 and the chronograph counter circuit 2098 perform the process of determining whether a predetermined time has elapsed after the non-charged time measurement start signal was input. However, the embodiment is not limited to this example. In the embodiment, the process may be performed by any one of the pulse down counter circuit 2093 and the chronograph counter circuit 2098.

In the embodiment, since the pulse down counter circuit 2093 operates even under a lower electric load compared to the chronograph counter circuit 2098, the power consumption is small. Consequently, when battery life is considered to be important, for example, the pulse down counter circuit 2093 may exclusively perform the above-described process of determining whether the above-described predetermined time has elapsed, in the embodiment.

The chronograph counter circuit 2098 has a wider range of measuring time and a higher measurement accuracy, compared to the pulse down counter circuit 2093. Accordingly, when the range or the accuracy is considered to be important, for example, the chronograph counter circuit 2098 may exclusively perform the process of determining whether the above-described predetermined time has elapsed, in the embodiment.

In the embodiment, when the above-described predetermined time is shorter than a time (for example, 3 minutes) that can be measured by the pulse down counter circuit 2093, the pulse down counter circuit 2093 may perform the process of determining whether the above-described predetermined time has elapsed, and when the above-described predetermined time is longer than a time that can be measured by the pulse down counter circuit 2093, chronograph counter circuit 2098 may perform the process.

In the electronic device 2 which does not include the chronograph (the chronograph frequency divider circuit 2096, the second driving pulse generation circuit 2097, the chronograph counter circuit 2098, the second driving circuit 2104, and the second driving portion 2105 in the embodiment), the pulse down counter circuit 2093 may exclusively perform the process of determining whether the above-described predetermined time has elapsed, for example.

In this manner, the present embodiment is an electronic device featured by measuring the non-charged time for which the secondary power supply portion is not charged, based on the driving signal which is generated by the clocking control portion based on the clock signal and drives the time display portion.

That is, the clocking control portion includes the pulse down counter measuring a time until the amount of energy of the driving signal generated based on the clock signal is decreased, and the pulse down counter portion measures the time of the non-charged state.

Alternatively, the clocking control portion includes the chronograph counter portion measuring a time elapsed from a point of time when the operation input is detected, and the chronograph counter portion measures the non-charged time.

As a result, the embodiment can share the existing hardware (for example, a memory) for measuring the process of determining whether the above-described predetermined time has elapsed, so that it is possible to miniaturize the electronic device 2.

The electronic device according to the embodiment described above is characterized in that the first energy is light energy. Accordingly, the electronic device can use light emitted thereto from its surroundings as an energy source, and the operation of the electronic device 1 can be secured without replacing the battery.

The electronic device according to the embodiment described above is characterized in that the operation input is a voltage according to the position of the winder. As a result, since the operation input is a voltage according to the position of the winder, it is possible to control the operation of the clocking portion 11 according to the position of the winder. Consequently, by controlling the operation of the clocking portion 11 by manipulating the position of the winder depending on the usage state such as shipment, a convenience that the user can operate the device in the operation state as the user wants is improved.

A part of the electronic device in the embodiment described above, for example, the low power consumption state control portion 105 or the clocking portion 11 may be realized by a computer. In this case, a program for realizing the control function of the part may be recorded in a computer-readable recording medium, and the program recorded in the recording medium may be executed by being read by a computer system, whereby the function may be realized. The "computer system" referred to herein is a computer system built in the electronic device and includes hardware such as OS, peripherals, or the like.

The "computer-readable recording medium" refers to a storage device such as a portable medium including a flexible disk, a magneto-optical disc, a ROM, and a CD-ROM, and a hard disk built in a computer system. Furthermore, the "computer-readable recording medium" may include a medium dynamically holding programs for a short time, such as a communication line in a case where the programs are transmitted through a network including the internet and a communication line including a telephone line, and a medium holding the programs for a certain period of time, such as a volatile memory inside the computer system serving as a server or a client in the case of transmitting the program. The program described above may be a program for realizing a part of the above-described function, or a program that can realize the function by combining the above-described function with a program which has already been recorded in the computer system.

A part of the electronic device in the embodiment described above, for example, the low power consumption state control portion 105 and the clocking portion 11 may be realized as an integrated circuit such as LSI (Large Scale Integration) or the like. Each functional block of the electronic device may be made into a separate processor, or a part or all of the functional blocks may be made into an integrated processor. In addition, a method of making the integrated circuit is not limited to the LSI, and may be realized by a dedicated circuit or a general-purpose processor. If the advance of semiconductor technology leads to the advent of a technology allowing the integrated circuit to replace the LSI, an integrated circuit produced from this technology may be used.

So far, an embodiment of the present invention has been described in detail with reference to the drawings. However, the specific configuration is not limited thereto, and various changes can be made in the design within a range that does not depart from the scope of the invention.

What is claimed is:

1. An electronic device comprising:

a primary power supply portion generating power by converting a first energy into electric energy as a second energy;

a secondary power supply portion storing the electric energy obtained by the power generation;

a charge detection portion detecting a state where the secondary power supply portion is not charged with the electric energy;

a clocking portion clocking time and stopping a display of clocked time when an operation input is detected; and a low power consumption state control portion which measures a time of a state where the operation input is detected and the charging is not performed, and stops the operation of the clocking portion when the measured time exceeds a preset time.

2. The electronic device according to claim 1 further comprising:

a voltage detection portion detecting supply voltage of the secondary power supply portion, wherein the charge detection portion detects a state where the secondary power supply portion is charged with the electric energy, and the low power consumption state control portion stops the operation of the clocking portion when the supply voltage of the secondary power supply portion is higher than the voltage required for the operation of the device, and starts the operation of the clocking portion when the charged state is detected.

3. The electronic device according to claim 1, wherein the low power consumption state control portion selects an operation state at the time when the operation of the clocking portion is started, according to the operation state before the operation of the clocking portion is stopped.

4. The electronic device according to claim 1, wherein the clocking portion is configured with a clocking control portion and an oscillation circuit control portion for generating clock signals to drive the clocking control portion, and the operation of the clocking portion is stopped when the oscillation circuit control portion stops generating the clock signals.

5. The electronic device according to claim 4, wherein the clocking control portion includes a pulse down counter portion measuring a time until the amount of energy of the driving signals generated based on the clock signals is reduced, and the pulse down counter portion measures a time of a state where the charging is not performed.

6. The electronic device according to claim 4, wherein the clocking control portion includes a chronograph counter portion measuring a time elapsed from a point of time when the operation input is detected, and the chronograph counter portion measures a time of a state where the charging is not performed.

7. The electronic device according to claim 1, wherein the first energy is light energy.

8. The electronic device according to claim 1, wherein the operation input is a voltage according to the position of a winder.

9. A control method of an electronic device comprising:

a process of measuring a time of a state where a clocking portion included in the electronic device has detected an operation input for stopping a time display, and a secondary power supply portion included in the electronic device is not charged with electric energy generated by a primary power supply portion included in the electronic device; and a low power consumption state control process stopping the operation of the clocking portion when the measured time exceeds a preset time.

10. A control program of an electronic device causing a computer included in the electronic device to execute:

a process of measuring a time of a state where a clocking portion included in the electronic device has detected an operation input for stopping a time display, and a secondary power supply portion included in the electronic device is not charged with electric energy generated by a primary power supply portion included in the electronic device; and a low power consumption state control process stopping the operation of the clocking portion when the measured time exceeds a preset time.

* * * * *